US006921472B1

(12) United States Patent
Dulcetti et al.

(10) Patent No.: US 6,921,472 B1
(45) Date of Patent: Jul. 26, 2005

(54) PROCESS FOR THE SOLUTION OF METALS INTO AN ELECTROLYTIC DEPOSITION SOLUTION AND SOLUTION PLANT OPERATING SUCH PROCESS

(75) Inventors: Alessandro Dulcetti, Rome (IT); Valerio Ghisolfi, Rome (IT); Medardo Pinti, Rome (IT); Maurizio Podrini, Rome (IT); Baldo Gurreri, Rome (IT)

(73) Assignee: Centro Sviluppo Materiali S.p.A., Rome (IT)

( * ) Notice: Subject to any disclaimer, the term of this patent is extended or adjusted under 35 U.S.C. 154(b) by 0 days.

(21) Appl. No.: 10/048,405

(22) PCT Filed: Sep. 24, 1999

(86) PCT No.: PCT/IT99/00302

§ 371 (c)(1),
(2), (4) Date: Aug. 27, 2002

(87) PCT Pub. No.: WO01/09409

PCT Pub. Date: Feb. 8, 2001

(30) Foreign Application Priority Data

Jul. 30, 1999 (IT) ..... RM99A0492

(51) Int. Cl.[7] ..... C25D 21/14

(52) U.S. Cl. ..... 205/101; 204/232; 204/237

(58) Field of Search ..... 205/99, 101; 204/232, 204/237

(56) References Cited

U.S. PATENT DOCUMENTS 4,789,439 A * 12/1988 Bunk et al. ..... 205/101
5,082,538 A * 1/1992 DeRespiris et al. ..... 205/140
5,312,539 A * 5/1994 Thomson ..... 205/101

OTHER PUBLICATIONS

Patent Abstracts of Japan, Pub. No. 03180492, Published Aug. 6, 1991, "Electroplating Method of Tin", Inventor: Sugiyama Seiji Application No. 01320276.
Patent Abstracts of Japan, Pub. No. 07041999 Published, Feb. 10, 1995, "Preparation of Tin Electroplating Bath", Inventor: Takahashi Koji Application No. 05183101.
Patent Abstracts of Japan, Pub. No. 53113728, Published Oct. 4, 1978, "Electro Tin Plating Method", Inventor: Ikebe Masaru Application No. 52029090.
Patent Abstracts of Japan, Pub. No. 09031699, Published Feb. 4, 1997, "Electro Tin Plating Method Using Insoluble Anode", Inventor: Mochizuki Kazuo Application No. 07186010.
Patent Abstracts of Japan, Pub. No. 53113729, Published Oct. 4, 1978, "Electro Tin Plating Method", Inventor: Ikebe Masaru, Application No. 52029091.
Patent Abstracts of Japan, Pub. No. 06316795, Published Nov. 15, 1994, "Method and Device for Feeding Metal Ion into Plating Liquid", Inventor: Sekida Takashi Application No. 05104132.
Patent Abstracts of Japan, Pub. No. 04314883, Published Nov. 6, 1992, "Tin Electroplating Method", Inventor: Sugiyama Seji, Application No. 03108194.

(Continued)

*Primary Examiner*—Roy King
*Assistant Examiner*—William T. Leader
(74) *Attorney, Agent, or Firm*—Browdy and Neimark, P.L.L.C.

(57) ABSTRACT

A process for dissolving metals, in particular tin, and a plant for dissolving metals operating according to said process allow to minimize the quantity of metal in the sludge and the oxygen consumption, and entail a first step in which in a first reactor an effective quantity of oxygen is solubilized in an electrolytic solution obtaining an oxygen-enriched electrolytic solution; and a second step, distinct from the former, in which in a second reactor said oxygen-enriched solution is flown through a bed of metal for the deposition in a metallic form.

12 Claims, 1 Drawing Sheet

OTHER PUBLICATIONS

Figures 1, 2:
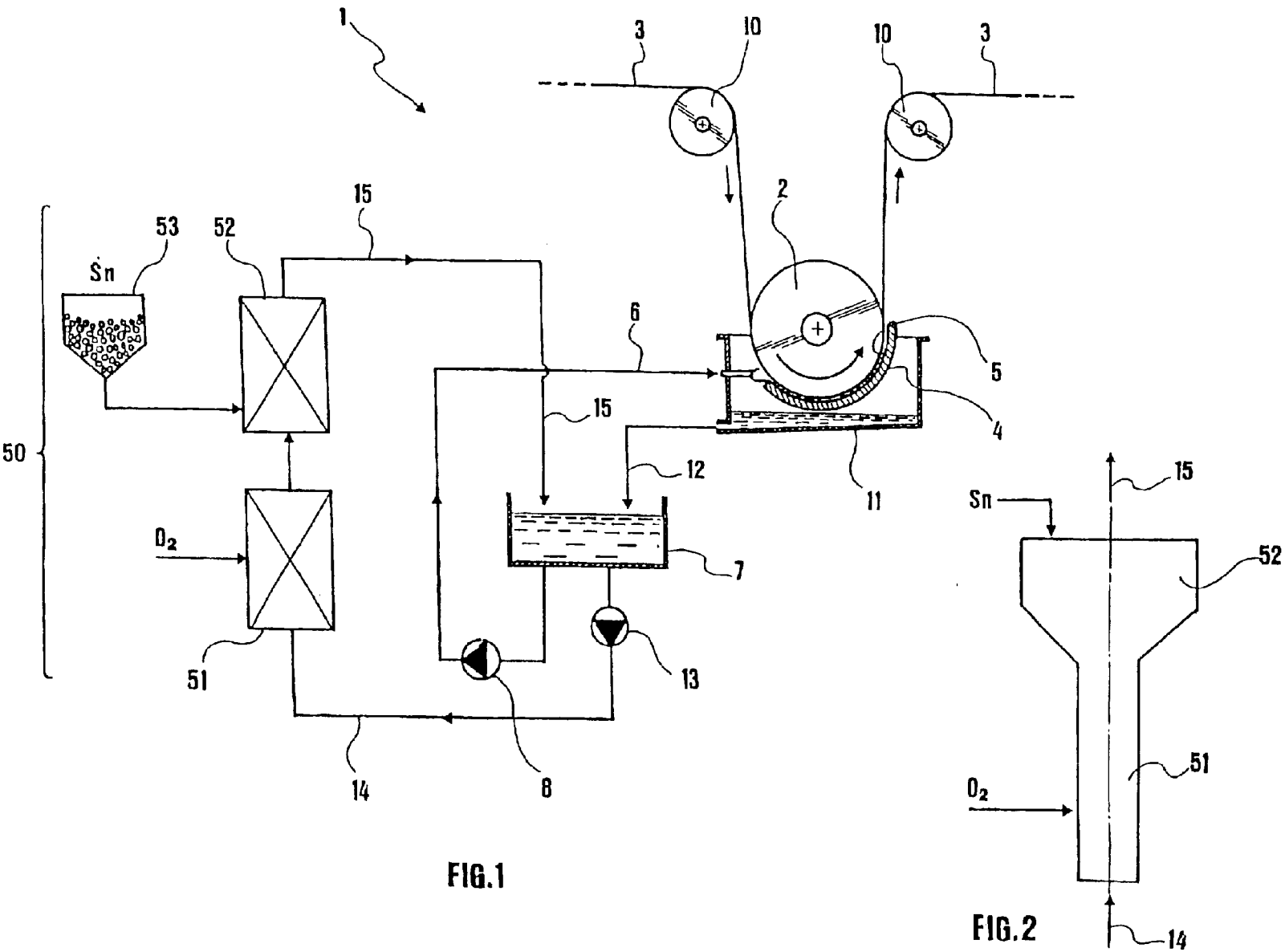

Patent Abstracs of Japan Pub No. 09031698, Published Feb. 4, 1997, "Electro Tin Plating Method Using Insoluble Anode", Inventor: Mochizuki Kazuo Application No. 07186009.

Derwent Publication "Tin Electroplating Process Tin Dissolve Oxygenate Solution Control Rate Produce Electrolytic", Pub. No. JP53113729, Published Oct. 4, 1978.

Derwent Publication "Tin Electroplating Process Tin Dissolve Oxygenate Solution Control Rate Produce Electrolytic" Pub. No. JP53113728, Published Oct. 4, 1978.

Derwent Publication "Prevent Sludge Formation Electroplating Tin @ Comprise Blow Inert Gas Through Melt Bath Prevent Oxidation Tin Ion" Pub. No. JP431 4883, Published Nov. 6, 1992.

* cited by examiner

PROCESS FOR THE SOLUTION OF METALS INTO AN ELECTROLYTIC DEPOSITION SOLUTION AND SOLUTION PLANT OPERATING SUCH PROCESS

DESCRIPTION

The present invention relates to a process for dissolving metals in a solution to perform an electrolytic plating and a metal dissolving plant operating according to said process.

In particular, the present invention relates, in its most general aspects, to the field of continuous insoluble anode electroplating of metallic strips, with the solution of metallic tin or lead in an electrolytic solution supplied at the electrodes.

Substantially, two kinds of plating processes are known: a first kind, widespread in tinning although not without relevant drawbacks, employs the so-called soluble anode method, according to which the anode is substantially composed of a coating metal that dissolves itself in ions into an acid or alkaline solution and that is electrolytically deposed.

A second kind, related to the present invention, refers instead to the use of the so-called insoluble anode, in which the metal for the deposition is contained in the solution supplied at the electrodes.

Such solution contains metallic ions and it is found to be depleted at the outlet in the planting area, obviously resulting more acid or alkaline.

In order to be recirculated at the electrodes, the depleted solution needs to be metal-enriched again in order to perform a continuous plating line.

This type of technology, known for tin e.g. from U.S. Pat. No. 4,181,580 (Kitayama et al.), provides several advantages, both in terms of product, as e.g., the even plating thickness and the surface appearance, and in terms or production efficiency.

However, the use of this technology was hindered by the fact that 25–30% of the tin dissolved in the solution precipitates in sludge. The processing of this sludge for the tin recovery is rather complex and costly.

To a certain extent, analogous problems were found in the case of different metals as well, and in particular with lead as well.

By way of example, the precipitation in sludge is due to the fact that the tin solution takes place according to two main reactions:

$$2Sn+O_2+4H^+ \rightarrow 2Sn^{2+}+2H_2O \quad (I)$$

$$Sn+O_2+4H^+ \rightarrow Sn^{4+}+2H_2O \quad (II)$$

In the steady state phase, the $Sn^{4+}$ originated by the reaction (II) precipitates as hydrate and/or oxides, forming said sludge. Moreover, the reaction (II) is thermodynamically favoured over (I).

JP 8-20899 discloses a combined chemical-electrochemical dissolving system.

U.S. Pat. No. 5,082,538 solves the metal enrichment problem by circulating the depleted solution in an electrolytic cell that contains metal particles or a metallic soluble anode.

U.S. Pat. No. 5,312,539 discloses an enrichment process in which the acid component is extracted from the solution and used for the metal dissolving. The latter two resolutions do not lead to dissolving rates useful in an industrial plant.

The technical problem underlying the present invention is that of providing a process and a plant for dissolving metals allowing to overcome the drawbacks mentioned with reference to the known art.

Such problem is solved by a process for dissolving metal in a solution to carry out a plating, characterised in that it comprises:

- a first step, wherein an effective quantity of oxygen is solubilized into an electrolytic solution for insoluble anode plating, depleted or said metallic ions to be deposed, obtaining an oxygen-enriched solution; and
- a second step, distinct from the former, wherein said oxygen-enriched solution is flown through a bed of said metal as metal to be plated.

Said problem is solved likewise by a plant for dissolving metals, operating according to a process as above-defined, comprising: at least one first reactor member wherein said first step can take place, provided with an oxygen injection system, wherein said first step is performed, and that is equipped with means for supplying therein a depleted electrolytic solution and at least one second reactor member, wherein said second step can take place, equipped with means for arranging therein a bed of metal in a metallic form to be deposed, said second reactor member being provided with means for supplying therein the solution enriched with oxygen drawn off from said first reactor member. The injection system of the plant according to the present invention can be provided with means for blowing in said oxygen flow in a parallel flow with respect of the electrolytic solution flow. The means for arranging a bed of metal to be deposed are suitable for arranging a non-fluidized bed, or slightly fluidized.

Moreover, the present invention also refers to an insoluble anode plating plant comprising at least one plant for dissolving plating metal as described above.

The main advantage of the process and of the plant according to the present invention lies in their allowing inside said depleted solution an optimum oxygen distribution that, hence, is completely solubilized, fostering inside said second reactor the reaction:

$$Sn^{4+}+Sn \rightarrow 2Sn^{2+} \quad (III)$$

The present invention will be hereinafter disclosed according to two embodiments of a tinning plant, given by way of example and not for limitative purposes, with reference to the following examples and to the annexed drawing, wherein:

FIG. 1 is a schematic view of a first embodiment of a tinning plant according to the invention; and FIG. 2 is a schematic view of a plant detail including a variant of said first embodiment.

It is understood that, adopting variants in the range of a person skilled in the art, said process and plants are also useful for the electrolytic plating with other metals, in particular lead.

With reference to FIG. 1, a plant for tin-plating metal strips is globally indicated with 1.

It comprises a roll 2 to which a metallic strip 3, apt to be tin-plated, adheres. At the roll 2, the tinplating plant comprises an anode plate 4, forming with said roll 2 a gap 5 filled with active electrolytic solution supplied by a feeding line 6 that draws in a circulating tank 7 thanks to the action of a first circulating pump 8.

The strip is negatively charged closing the circuit with the roll 2, or with the metal deflector rolls 10, or with contact rolls located near the deflector rolls 10. The power supply is not shown in the figure.

Said anode plate 4 forms an insoluble anode according to the definition that is commonly accepted in the state of the art.

Below the anode plate 4, a collection tank 11 collects the excess of depleted electrolytic solution from the electroplating. The depleted electrolytic solution is delivered, through an exhaust line 12, to said circulating tank 7.

In the present embodiment, such solution is of the acid type, and it contains phenolsulfonic acic (PSA) and a quantity of $Sn^{2+}$ ions comprised between 15 g/dm$^3$ and 40 g/dm$^3$.

A flow of depleted electrolytic solution to be enriched is drawn off from the circulating tank 7 by a second circulating pump 13, and it is delivered, through an injection duct 14, to an area of the tin-plating plant that includes a plant for dissolving metallic tin, indicated with 50 as a whole.

Said plant for dissolving 50 comprises a first reactor member that, in the present embodiment, is a first reactor 51 that is supplied with said solution through the injection piping 14.

Inside the plant 50 for dissolving, a pressure, comprised between 100 kPa and 1000 kPa determined by the second circulating pump 14, and a controlled temperature preferably comprised between 20° C. and 50° C. are maintained.

Preferably, said pressure inside the first reactor is comprised between 200 kPa and 600 kPa, whereas the temperature is preferably comprised between 30° C. and 40° C.

Inside said first reactor 51, an oxygen flow rate is injected, whose ratio with the solution flow rate is comprised between 1/100 and 1/4, preferably between 1/20 and 1/8.

In the present example, said oxygen flow is injected in parallel current with respect to the electrolytic solution flow, thus improving the dissolving effectiveness, as it will be apparent hereinafter.

At the outlet of said first reactor, the oxygen-enriched electrolytic solution flows into a second reactor member, that in the present embodiment, is a second reactor 52, containing a metal to be deposed in a metallic form.

Such bed is preferably of a non-fluidized, or slightly fluidized, type, and it is supplied with granulated tin from a hopper 53.

It is understood that in other embodiments a number greater than one of first reactor members and/or of second reactor members, in this example first reactors and second reactors, suitably located in parallel therebetween, may be used, i.e., more parallel plants for dissolving 50 in the same tin-plating plant 1.

Concerning said second reactor 52, the overall height of the tin bed, i.e. the sum of the heights of each bed in each first reactor member of the plant for dissolving 50, is greater than or equal to 1500 diameters ($\phi^2$) of the tin particles of the bed, preferably equal to 2500 diameters ($\phi^2$) of the tin particles.

Inside the second reactor 52, the ratio between the dissolved tin quantity and the tin charge inside the second reactor is comprised between 10 g/h·kg and 250 g/h·kg; more than 90% of the supplied oxygen is used for the tin metal solution, with a high solution rate.

From the second reactor 52, into which metallic tin stored in the hopper 53 is let in, a solution enriched with dissolved metallic tin is delivered to said collection tank 11 through an ejection duct 15.

With reference to FIG. 2, a variant of the above-mentioned plant for dissolving 50 is disclosed, having a first reactor member and a second reactor member embodied in a single reactor body which, however, is divided into a first reactor stage 51, corresponding to the first reactor member, and a second reactor stage 52.

The operation of said stages 51, 52 is substantially analogous to that of the reactors hereto disclosed: the oxygen is injected inside the first stage 51, whereas the second stage 52 contains a tin bed, analogous to the above-described one, likewise supplied with granulated tin.

Also the physical parameters, pressure, temperature, discharges etc., vary according to the above-disclosed ranges.

The division of the stages 51, 52 depends, in this case, on the reactor body shape, a substantially unvarying diameter in the first stage 51 and a substantially increasing diameter in the second stage 52, and on the different locations of oxygen injection and tin supply.

Obviously, a tin plating plant 1 as disclosed-above can comprise a single reactor body or even several parallel reactor bodies.

With reference to the above-disclosed metal plants for dissolving 50, the dissolving process comprises a first step, taking place inside a first reactor member, in which a supply of electrolytic solution depleted of ionic tin, is oxygenated by injection of an oxygen flow, preferably in parallel with respect to the electrolytic solution flow.

The first reactor member is provided with a suitable injection system to carry out the injection.

The solution is e.g. of the acid type and contains phenolsulfonic acid (PSA) and a quantity of $Sn^{2+}$ ions comprised between 15 g/dm$^3$ 40 g/dm$^3$.

During this step, and in the subsequent ones, a pressure comprised between 100 kPa and 1000 kPa and a controlled temperature, comprised between 20 ° C. and 50° C. are kept constant.

Preferably, said pressure is comprised between 200 kPa and 600 kPa, whereas the temperature is preferably comprised between 30° C.–40° C.

The ratio between the injected oxygen flow and the electrolytic solution supply is comprised between 1/100 and 1/4, preferably between 1/20 and 1/8.

In such first step, an effective quantity of oxygen is solubilized into said depleted electrolytic solution, obtaining an oxygen-enriched solution.

The process according to the invention comprises a second step, distinct from the former, in which said oxygen-enriched electrolytic solution is flown through a metal bed for plating, in this example a bed of granulated or particulate tin metal.

Such bed, contained inside a second reactor member, is preferably of a non-fluidized or slightly fluidized type.

As already pointed out with reference to the plant for dissolving 50, the overall height of the tin bed is greater than or equal to 1500 diameters ($\phi^2$) of the tin particles, preferably equal to 2500 diameters ($\phi^2$) of the tin particles.

During said second step, the ratio between the quantity of dissolved tin and the tin charge of the bed is comprised between 10 g/h kg and 250 g/h·kg: more than 90% of the supplied oxygen is used for dissolving metallic tin, with a high dissolving rate.

At the end of said second step, an electrolytic solution containing 25–60 g/dm$^3$ of $Sn^{2+}$ is obtained.

The above-disclosed process allows to minimize the precipitated sludge, obtaining a quantity of precipitated tin equal to the 5–10%, with respect to the dissolved tin, hence comparable to what is obtained by the technologies of the soluble anode type.

Operating with a distinct pair of reactor members, an optimum oxygen distribution can be obtained in the oxygen-enriched electrolytic solution, with all the oxygen already in the electrolytic solution on the superficial layers of the metallic charge of the second reactor member. The desired oxygen concentration is readily reached, with the entailed increase in the reaction rate between tin and oxygen.

The proposed balance between the homogeneity of the oxygen concentration and the non-fluidized tin metal bed allows to maximize the reaction (I) and to minimize the reaction (II) leading to the forming of sludge, with an evident advantage in the efficiency of the used oxygen.

EXAMPLE 1

A solution was produced out in a bath containing $Sn^{2+}$ ions at an initial concentration of 24 g/dm$^3$ phenosulfonic acid at a concentration, estimated as sulphuric acid $H_2SO_4$, of 15 g/dm$^3$.

With reference to a plant for dissolving metal comprising distinct first and second reactors, a normalized $O_2$ quantity equal to 240 dm$^3$/h was injected, and the electrolytic solution was maintained at a pressure of 300 kPa and at a temperature of 35° C. The supply of the electrolytic solution through the reactor equalled 5 m$^3$/h, determining a ratio between the oxygen supply and the solution supply equal to 1/21.

The electrolytic solution thus treated was let in a slightly mixed bed, consisting of 50 kg of metallic tin particles, with a maximum particle size of 2 mm.

A 2200 g/h dissolving rate, i.e.—of 8 mg/cm$^2$·h, and a tin precipitation in the sludge equal-to the 8% of the dissolved tin were obtained. The oxygen effectiveness was proved to be of over 90%.

EXAMPLE 2

A solution was produced in a bath containing $Sn^{2+}$ ions at an initial concentration of 28 g/dm$^3$ and phenosulfonic acid at a concentration, estimated as sulphuric acid $H_2SO_4$, of 15 g/dm$^3$.

With reference to a single reactor body divided into a first and a second reactor stage, a quantity of normalized $O_2$ equal to 480 dm$^3$/h was injected, and the electrolytic solution was maintained at a pressure of 500 kPa and at a temperature of 35° C. The supply of the electrolytic solution through the reactor equalled 5 m$^3$/h, determining a ratio between the oxygen supply and the electrolytic solution supply equal to 1/10.

The electrolytic solution thus treated was let in a slightly mixed bed, consisting of 50 kg of metallic tin particles, with a maximum particle size of 2 mm.

A dissolving rate of 4300 g/h, i.e., of 17 mg/cm$^2$·h, and a tin precipitation in the sludge equal to 10% of the dissolved tin were obtained. The oxygen effectiveness was proved to be of over 90%.

EXAMPLE 3

A solution was produced in a bath containing $Sn^{2+}$ ions at an initial concentration of 25 g/dm$^2$ and phenosulfonic acid at a concentration, estimated as sulphuric acid $H_2SO_4$, of 15 g/dm$^3$.

With reference to a plurality of plants for dissolving in parallel, a normalized $O_2$ quantity equal to 240 dm$^3$/h was injected, and the solution was maintained at a pressure of 300 kPa and at a temperature of 35° C. The electrolytic solution supply through the reactor equalled 5 m$^3$/h, determining a ratio between the oxygen supply and the electrolytic solution supply equal to 1/21.

The electrolytic solution thus treated was let in a slightly mixed bed consisting of 50 kg of tin metal particles with a maximum particle size of 2 mm.

A dissolving rate of 2000 g/h and a tin precipitation in the sludge equal to the 10% of the dissolved tin were obtained.

The process for dissolving linked to the insoluble anode deposition yields a tin precipitation in the sludge usually far superior to the one obtained by the soluble anode technology.

Adopting the technology object of the present invention, a tin quantity can be precipitated in the sludge which is comparable to the quantity usually precipitated in the plants having a soluble anode technology , and in particular a quantity of tin in the sludge not exceeding 10% of the dissolved tin.

Therefore, using the subject matter of the present invention the provision of a plant for the treatment and the recovery of tin from the sludge becomes unnecessary.

To the above-described process and metallic tin plant for dissolving, as well as to the tin-plating plant, a person skilled in the art, in order to satisfy further and contingent needs, may carry out several further modifications and variants, all however comprised within the protective scope of the present invention, as defined by the annexed claims.

What is claimed is:

1. A process for dissolving a metal in an insoluble anode electroplating solution depleted in the ions of said metal to be deposited, comprising:

oxygenating a flow of depleted electrolytic solution by injection of an oxygen flow in parallel with respect to said flow of depleted electrolytic solution, thus obtaining an oxygen-enriched electrolytic solution, the ratio between the oxygen flow rate and the flow rate of the depleted electrolytic solution being between 1/20 and 1/8, and then, in a second stage, distinct from said oxygenating, flowing said oxygen-enriched electrolytic solution through a non-fluidized or slightly fluidized bed of particles of said metal.

2. The process according to claim 1, wherein said metal is selected from the groups consisting of tin, lead and alloys thereof.

3. The process according to claim 2, wherein said metal is tin.

4. The process according to claim 3, wherein said depleted electrolytic solution contains a quantity of $Sn^{2+}$ ions between 15 g/dm$^3$ and 40 g/dm$^3$.

5. The process according to any one of claims 1, 2 or 3, comprising maintaining a pressure of between 100 kPa and 1000 kPa.

6. The process according to claim 5, wherein said pressure is between 200 kPa and 600 kPa.

7. The process according to any one of claims 1, 2 or 3, comprising maintaining a temperature between 20° C. and 50° C.

8. The process according to claim 7, wherein said temperature is between 30° C. and 40° C.

9. The process according to claim 3, wherein the overall height of the tin bed is greater than or equal to 1500 diameters ($\phi^2$) of the tin particles.

10. The process according to claim 9, wherein height (H) of the tin bed is equal to approximately 2500 diameters ($\phi^2$) of the tin particles.

11. A plant (50) for dissolving metals in an insoluble anode electroplating solution, depleted in the ions of the metal to be deposited, comprising:

at least one first reactor member (51) provided with means for supplying the depleted solution and with an oxygen injection system with means for injecting said oxygen flow in parallel with respect to the direction of flow of depleted solution at an oxygen flow rate relative to the flow rate of the depleted solution between 1/20 and 1/8, whereby oxygen-enriched electroplating solution is produced at a downstream location of said first reactor member;

and at least one second reactor member (52) downstream of said first reactor member, adapted to receive the oxygen-enriched electroplating solution, said second reactor member being provided with means for arranging therein a non-fluidized or slightly fluidized bed of particles.

12. An insoluble anode (4) plating plant (1) comprising at least one plant (50) for dissolving metals in an insoluble anode electroplating solution according to claim 11.

* * * * *